US009821369B2

(12) United States Patent
Benedetti et al.

(10) Patent No.: US 9,821,369 B2
(45) Date of Patent: Nov. 21, 2017

(54) ROLLING METHOD FOR STRIP AND CORRESPONDING ROLLING LINE

(75) Inventors: Gianpietro Benedetti, Tricesimo (IT); Paolo Bobig, San Canzian d'Isonzo (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 284 days.

(21) Appl. No.: 13/983,407

(22) PCT Filed: Feb. 2, 2012

(86) PCT No.: PCT/IB2012/000151
§ 371 (c)(1),
(2), (4) Date: Oct. 11, 2013

(87) PCT Pub. No.: WO2012/104710
PCT Pub. Date: Aug. 9, 2012

(65) Prior Publication Data

US 2014/0034264 A1 Feb. 6, 2014

(30) Foreign Application Priority Data

Feb. 3, 2011 (IT) ..... UD2011A0013

(51) Int. Cl.
*B22D 11/12* (2006.01)
*B21B 1/46* (2006.01)
(Continued)

(52) U.S. Cl.
CPC ..... *B22D 11/12* (2013.01); *B21B 1/46* (2013.01); *B21B 13/22* (2013.01); *B21B 1/26* (2013.01);
(Continued)

(58) Field of Classification Search
CPC .... B21B 1/06; B21B 1/14; B21B 1/26; B21B 1/32; B21B 1/34; B21B 1/026;
(Continued)

(56) References Cited

U.S. PATENT DOCUMENTS 5,435,164 A * 7/1995 Di Giusto ..... B21B 1/26 72/202
5,437,089 A * 8/1995 Salganik ..... B21B 1/34 29/33 C
(Continued)

FOREIGN PATENT DOCUMENTS

AT 507663 A4 7/2010
CN 101336307 A 12/2008
(Continued)

OTHER PUBLICATIONS

Translation of Claims and Specification of WO 0010741 from EPO website.*
(Continued)

*Primary Examiner* — R. K. Arundale
*Assistant Examiner* — Pradeep C Battula
(74) *Attorney, Agent, or Firm* — Calfee Halter & Griswold LLP

(57) ABSTRACT

Rolling method for the production of flat products with low productivity, which includes a continuous casting step at a speed between 3.5 m/min and 6 m/min of a thin slab with a thickness between 25 and 50 mm. It also includes a roughing step to reduce the thickness in at least one roughing stand to a value between 6 mm and 40 mm, and suitable for winding, a rapid heating step by means of induction in order to at least restore the temperature lost in the segment downstream of casting and in the roughing step, a winding/unwinding step in a winding/unwinding device with two mandrels. The method also includes a rolling step in a rolling unit that
(Continued)

consists of a single reversing stand of the Steckel type to roll the product unwound by the winding/unwinding device.

9 Claims, 2 Drawing Sheets

(51) Int. Cl.
*B21B 13/22* (2006.01)
*B21B 1/26* (2006.01)
*B21B 1/34* (2006.01)
*B21B 15/00* (2006.01)

(52) U.S. Cl.
CPC ..... *B21B 1/34* (2013.01); *B21B 15/005* (2013.01); *B21B 2015/0057* (2013.01); *B21B 2015/0064* (2013.01)

(58) Field of Classification Search
CPC ..... B21B 1/463; B21B 13/22; B21B 15/005; B21B 45/004; B21B 2015/0064; B21B 2015/0057; B21B 1/46; B22D 11/22
See application file for complete search history.

(56) References Cited

U.S. PATENT DOCUMENTS

| | | | | |
|---|---|---|---|---|
| 5,647,236 | A | 7/1997 | Tippins | |
| 5,706,690 | A | 1/1998 | Connolly | |
| 6,062,055 | A * | 5/2000 | Bobig | B21B 1/26 72/200 |
| 6,182,490 | B1 | 2/2001 | Ginzburg et al. | |
| 6,199,620 | B1 * | 3/2001 | Benedetti | B21B 1/466 164/418 |
| 6,264,767 | B1 | 7/2001 | Frank et al. | |
| 7,121,130 | B2 | 10/2006 | Kirstein et al. | |
| 7,363,792 | B2 | 4/2008 | Modrow et al. | |
| 9,126,246 | B2 | 9/2015 | Bendetti et al. | |
| 9,433,983 | B2 * | 9/2016 | Benedetti | B21B 1/463 |
| 2010/0252149 | A1 * | 10/2010 | Arvedi | C21D 8/0405 148/567 |
| 2012/0067095 | A1 | 3/2012 | Hohenbichler | |

FOREIGN PATENT DOCUMENTS

| | | | |
|---|---|---|---|
| DE | 69302332 | T2 | 8/1996 |
| DE | 102005052774 | | 6/2006 |
| EP | 0576890 | B1 | 4/1996 |
| EP | 0937512 | | 8/1999 |
| IT | UD92A000118 | | 6/1992 |
| JP | 59191502 | | 10/1984 |
| JP | 11207403 | A | 8/1999 |
| WO | 0010741 | | 3/2000 |
| WO | 2010115698 | | 10/2010 |
| WO | 2011080300 | | 7/2011 |

OTHER PUBLICATIONS

International Search Report and Written Opinion from PCT/IB2012/000073 dated Mar. 30, 2012.
International Preliminary Report on Patentability for PCT/IB2012/000073 dated Jan. 15, 2013.
International Search Report and Written Opinion from PCT/IB2012/000151 dated May 16, 2012.
Notice of Opposition from Patent No. EP266798 dated Aug. 19, 2015(German only).
Office Action from U.S. Appl. No. 13/981,536 dated Nov. 19, 2015.
Office Action from Chinese Patent Application No. 201280014721.7 dated Jun. 18, 2015.
Notice of opposition from Patent No. EP2670539 dated Apr. 8, 2015 (German only).

* cited by examiner

ROLLING METHOD FOR STRIP AND CORRESPONDING ROLLING LINE

CROSS-REFERENCE TO RELATED APPLICATION

This application is the U.S. national phase entry of PCT/IB2012/000151, with an international filing date of 2 Feb. 2012, which claims the benefit of Italian Application Serial No. UD2011A000013, with a filing date of 3 Feb. 2011, the entire disclosures of which are fully incorporated herein by reference.

FIELD OF THE INVENTION

The present invention concerns a rolling method and corresponding line, to obtain flat metal products, such as strip, in particular a low productivity method and line.

BACKGROUND OF THE INVENTION

Processes and plants for the production of hot-rolled steel strip which use a Steckel rolling mill with one or more reversing stands normally fed with slabs with a thickness from 150 to 250 mm.

Such plants typically provide, a slab casting machine, shearing means, a heating furnace to restore, maintain or homogenize the temperature of the cast slab so that it is suitable for subsequent rolling, a high-pressure water descaler, a Steckel reversing rolling train with one or two stands, a laminar cooling system and a winding unit to wind the strip into rolls of a predefined weight.

It is also known that rolling plants with a Steckel reversing rolling train with one or more stands, which use a slab with a thickness from 150 to 250 mm or more have limitations in terms of the minimum thickness obtainable and in the quality, both of size and surface, of the final strip.

Indeed, because of the great thickness of the starting slab, the large number of rolling passes through the stand/stands and consequently of the long downtimes of inversion, with consequent long total times from beginning to end of rolling, there is a big loss of temperature which makes it impossible to roll thin thicknesses of final product, for example 1.6-1.4 mm or less.

Moreover, there is lack of homogeneity in the temperature along the strip and the formation of scale, which negatively affect the quality of the strip produced.

Finally, the surface quality of the finished product also suffers from the effect of using the work rolls for the numerous passes of the cold leading/tail ends and the consequent rapid deterioration of the surface of the rolls themselves. To reduce this disadvantage, it is necessary to change the work rolls frequently, with consequent stoppages, compromising the factor of use and productivity of the plant.

Another problem found is such production lines is the overall great length of the line, which negatively affects not only the investment costs but also the energy costs of production and maintenance costs.

WO-A-00/10741 describes a rolling method that, in one form of embodiment, provides a continuous casting step, a roughing step, directly downstream of casting, a heating step carried out after roughing and upstream of a finishing rolling step. In another alternative form of embodiment of WO'741, between the roughing step and the heating step a winding/unwinding step is provided. In another alternative form of embodiment of WO'741, the heating step is the rapid type and is provided directly downstream of casting, whereas the roughing step is provided after the rapid heating, very distant from casting. After the roughing step a winding/unwinding step is provided, after a possible further heating step, which makes the method and connected rolling line according to WO'741 more expensive and dimensionally bigger, and finally the finishing rolling, WO-A-2010/115698 describes a rolling method that only provides a continuous casting step, a roughing step, a rapid heating step after roughing, a step of detecting scale, a pre-cooling step, a de-scaling step and finally a finishing rolling step.

JP-A-59191502 describes a rolling unit provided with a single Steckel type rolling stand, equipped with induction type heating means disposed between the rolls of the rolling stand and the reel furnaces at entrance to and exit from the rolling stand.

Primary purpose of the present invention is to obtain a process and corresponding line for the hot production of steel strip which is extremely compact, with low investment costs, which allows to obtain final thicknesses of 1.4 mm or less.

Another purpose is to obtain a finished product with good quality in terms of less scale impressed, good surface quality and dimensional tolerance even along the length.

Another purpose of the present invention is to perfect a method that allows to reduce to a minimum the number of rolling passes and inversions, and hence to reduce the total rolling time, with consequent greater uniformity/homogeneity of temperature along the strip being rolled and a lesser overall loss of temperature of the strip.

Furthermore, another purpose is to obtain a production line that transforms, in a single continuous cycle, without intermediate storage and recovery of material, and with extremely limited energy consumption, the liquid steel arriving from the steel works and which is able to produce, at competitive costs compared to other, conventional technologies, final product in a range comprised from about 300,000 to about 800,000 tonnes per year.

Another purpose is to increase the factor of use of the production line, increasing the operating life of the work rolls.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe variants to the basic solution.

According to the present invention, in order to obtain all the purposes and advantages set forth above and hereafter, the rolling method for the production of flat products at low productivity comprises a continuous casting step at a speed comprised between 3.5 m/min and 6 m/min of a thin slab with a thickness comprised between 25 and 50 mm, advantageously between 30 and 40 mm, a roughing step to reduce the thickness in at least one roughing stand to a value comprised between 6 mm and 40 mm, preferably between 6 mm and 20 mm, even more preferably between 6 mm and 15 mm and suitable for winding, a rapid heating step by means of induction in order to at least restore the temperature lost in the segment downstream of casting and in the roughing step, a winding/unwinding step in a winding/unwinding device with two mandrels, which is carried out subsequent to the rapid heating step, a reversing-type rolling step of the product unwound from the winding/unwinding device in a rolling unit that consists of a single reversing stand of the Steckel type, said rolling step comprising at most five rolling passes or four inversions, in order to obtain a final product with a thickness comprised between about 1.4 mm and 10 mm, preferably between about 1.4 mm and 8 mm, a cooling step and a step of winding the final product.

In particular, it comes within the spirit of the present invention to provide that with a single roughing stand and a single reversing stand it is possible to obtain thickness of the final product of as little as about 4 mm at most with three rolling passes (two inversions), whereas thicknesses from about 1.4 mm and 4 mm are obtained with at most five rolling passes (four inversions), whereas with two roughing stands and a single reversing stand it is possible to obtain thicknesses of the final product up as little as about 2 mm at most with three rolling passes (two inversions), while thicknesses from about 1.4 mm to 2 mm are obtained with at most five rolling passes (four inversions).

The present invention allows to exploit the high temperature of the cast material directly upon exit from the casting step for the roughing step made directly and immediately downstream of casting, with consequent energy saving.

Moreover, with the present invention, the provision of one or two roughing stands directly downstream of casting optimizes the thickness of the bar, so as to always have the minimum uneven number possible of rolling passes in the single reversing Steckel stand.

Furthermore, the provision of a single rapid heating step reduces energy consumption and renders the line more compact.

Here and hereafter in the description, the pre-rolled product resulting from the roughing step downstream of casting will be called simply "bar".

In variants of the method, each roughing stand performs a reduction in thickness comprised between 20% and 60%, advantageously between 35% and 55%.

The at least one roughing stand, exploiting the high temperature at exit from casting and the lower resistance of the material because of the lack of "re-crystallization", allows to use smaller stands, which require less power installed, and therefore the costs, both intrinsic and of installation, of the at least one roughing stand are lower.

In accordance with one form of embodiment of the method according to the present invention, depending on the number of roughing stands and at least of the following parameters:

final thickness of the strip, width of the strip, type of steel (or "steel grade"), the rolling step in the reversing Steckel stand can occur advantageously with at most three passes only, or two inversions.

In this case therefore, reducing the number of (uneven) rolling passes and (even) correlated inversions to the minimum value possible, and therefore the total rolling time and the inversion downtimes, the time when the rolling product is exposed to the air is reduced to a minimum and also the formation of scale and its impression on the surface of the strip.

Moreover, a much smaller increase in temperature and an improvement in homogeneity/uniformity of the temperature along the strip is achieved. The final product therefore has better dimensional tolerance.

Furthermore, the number of times that the cold leading/tail ends pass under the work rolls is reduced, with less wear on the rolls and therefore better dimensional and surface quality of the final strip.

By also increasing the operating life of the work rolls the stoppages of the rolling mill to change the rolls are reduced, with a consequent improvement in the factor of use of the plant.

In some forms of embodiment, the reduction of the scale can be further increased with de-scalers, for example using water at very high pressure, which cleans the finished strip in the winding steps.

In a first form of embodiment, with only one roughing stand, at most three rolling passes, or two inversions can be sufficient in the reversing rolling train for thicknesses of the final strip of more than 4 mm. In this form of embodiment, for thicknesses of less than 4 mm, up to 1.4 mm, a maximum of five rolling passes or four inversions are needed.

In an advantageous second from of embodiment, with two roughing stands, at most three rolling passes or two inversions are needed in the reversing rolling train for thicknesses of the final strip of more than 2 mm and up to 10 mm, preferably up to 8 mm. In this second form of embodiment, for thicknesses of less than 2 mm, up to 1.4 mm, a maximum of five rolling passes or four inversions are needed.

In another form of embodiment, with two roughing stands and for thicknesses of the final strip of more than about 5-6 mm the rolling in the reversing Steckel stand can occur advantageously with a single rolling pass and therefore without inversions and without the use of the winding reels, thus reducing drastically the exposure time of the product to the air and therefore the formation of scale.

The method, according to some forms of embodiment, is also able to carry out a dynamic reduction of the thickness of the cast slab with liquid core, or so-called dynamic soft reduction, downstream of the crystallizer, in order to obtain a better metallurgic structure. The thickness obtained after dynamic soft reduction is comprised between 25 mm and 50 mm If there is no soft-reduction unit present, it is the crystallizer itself that directly supplies the final thickness of the slab.

The method according to the present invention focuses on low productivity, deliberately sought in order to satisfy particular requirements of local markets and hence to save on investment costs, while at the same time maintaining high quality of the product. The plant adopting the method allows to operate in sequence with electric furnaces, or with other production devices for liquid steel, at a rhythm of from 40 to 140/150 tons/hour.

Since we have a low casting speed and a small thickness of the product cast, the mass flow, which is given precisely by the product of the casting speed and casting thickness, is consequently low and does not allow to have temperatures suitable for rolling downstream: the inductor furnace and the heated winding/unwinding device are advantageous because they respectively allow to restore the temperature and to keep it at the value required for the subsequent rolling in the reversing train.

It is advantageous to use the winding/unwinding device, which combines well with the low productivity and reduced mass-flow of the casting, since it allows to avoid using very long tunnel furnaces able to contain a thin slab with a length equivalent to a roll of finished strip weighing 25-30 tons. Furthermore, with the winding/unwinding device, the problem of moving a very thin slab inside the tunnel furnace is solved, which would further complicate production and increase costs.

In other variants, the winding/unwinding device functions as a store to allow roll change, since the time required for winding the bar on the mandrel of the winding/unwinding device is coherent with the time required for the roll change of the reversing stand.

According to another feature of the method of the present invention, the bar that is fed to the reversing rolling step, thanks to the suitable thickness that it already has in this step, can be wound immediately on a winding reel downstream, so that it prevents the problem, common in the state of the art, of moving the long bar on a plane on the run-out table for two or more passes through the mill before being able to wind it on the winding reels upstream and downstream.

The main advantage of winding the bar immediately after the first rolling pass is to reduce the overall dimensions of the line and to reduce the time the product is exposed to air, which causes scale, and to contain the heat losses, which gives the advantage of a far lower temperature drop and a greater uniformity between the head/tail end and the central part of the bar being rolled. This has a positive effect on the dimensional and surface quality of the finished strip and also on the possibility of obtaining thin thicknesses.

The present invention also concerns a rolling line for the production of flat products with low productivity which comprises a casting machine able to continuously cast a thin slab at low speed, for example comprised between 3.5 and 6 m/min, a rapid heating unit and a rolling unit comprising a single reversing stand of the Steckel type. The solution with the reversing rolling unit allows to reduce the number of stands, and hence the bulk and costs of making it, compared to a continuous rolling train.

Moreover, according to the present invention, the rolling line provides a forming stand or roughing stand, directly connected immediately at the exit of the continuous casting machine and upstream of the rapid heating unit, which is able to reduce the thickness of the material just solidified and still at a high temperature.

Each roughing stand is configured to allow a reduction in thickness comprised between 20 and 60%, advantageously between 35 and 55%, and, exploiting the high temperature at casting exit and the lower resistance of the material due to the lack of re-crystallization, allows to use smaller stands, which require less power installed, and hence to obtain a considerable energy saving.

The provision of one or two roughing stands advantageously allows to feed the reversing stand of the rolling unit with a bar thickness so that the final product is obtained with a maximum of five rolling passes, that is four inversions, and preferably with at most three rolling passes, that is two inversions, according to the final thickness to be obtained.

In other Words, the provision of one or two roughing stands directly downstream of the casting optimizes the thickness of the bar so as to always have the minimum uneven number possible of rolling passes in the single reversing Steckel stand.

Moreover, advantageously, the reduction in thickness in the at least one roughing stand not only makes the bar windable on the winding/unwinding device, but also allows to feed the rolling train with reduced thicknesses, therefore the Steckel stand can have work rolls with a diameter of a smaller size, allowing, given the same compression, rolling forces which are 20-30% lower, with consequent reduction in the sizes of the machine. Moreover, lower rolling forces also entail reduced rolling torque, and the size of the main motors will consequently have a lower torque value, even less than 30-40%.

According to one feature of the present invention, the rapid heating unit is an inductor furnace configured to at least recover the temperature losses deriving from the pass in the roughing stand, and downstream of the inductor furnace there is a winding/unwinding device with at least two mandrels able to selectively and alternately perform the function of winding the bar arriving from casting and to unwind it so as to feed it to the single reversing stand of the rolling unit. The reversing stand is configured to perform a rolling operation comprising at most five rolling passes or four inversions, in order to obtain a final product with a thickness comprised between about 1.4 mm and 10 mm, preferably between about 1.4 mm and 8 mm.

The line according to the present invention allows to have a low productivity, in any case maintaining a good quality of the final product.

Moreover, the reduced overall development of the production line, which has a very short layout, allows to compress and rationalize the spaces occupied with considerable advantages in making civil engineering works, such as foundations, warehouses, tubing, infrastructures etc. This advantageously entails less outlay of capital for investment compared to a plant of the state of the art.

The present invention exploits to the utmost the low resistance to deformation of steel at high temperatures, which it has just after it solidifies, to perform the roughing rolling of the product exiting from the continuous casting machine, and is thus able to use smaller roughing stands and therefore with less power installed, a considerable reduction in energy needs and improved environmental compatibility.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
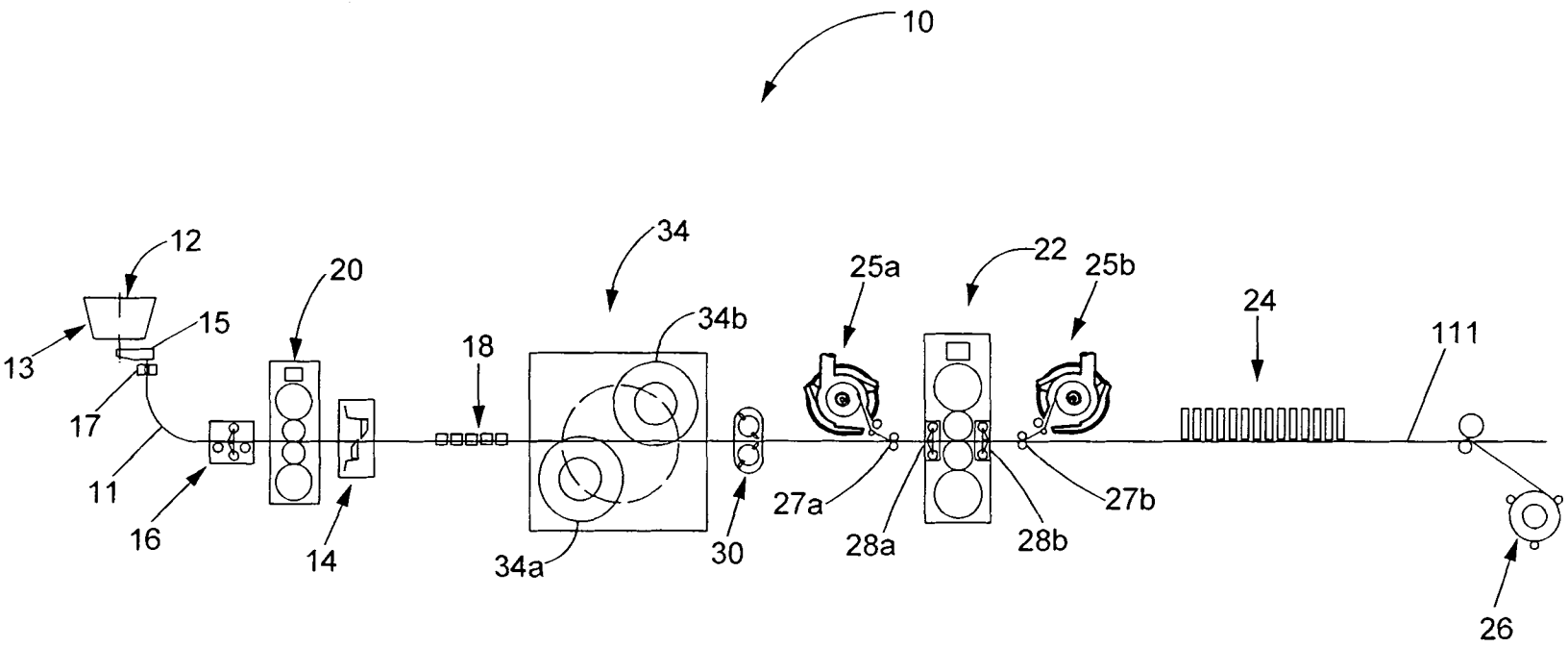
FIG. 1 schematically shows a first form of embodiment of the rolling line according to the present invention.
Figure 2:
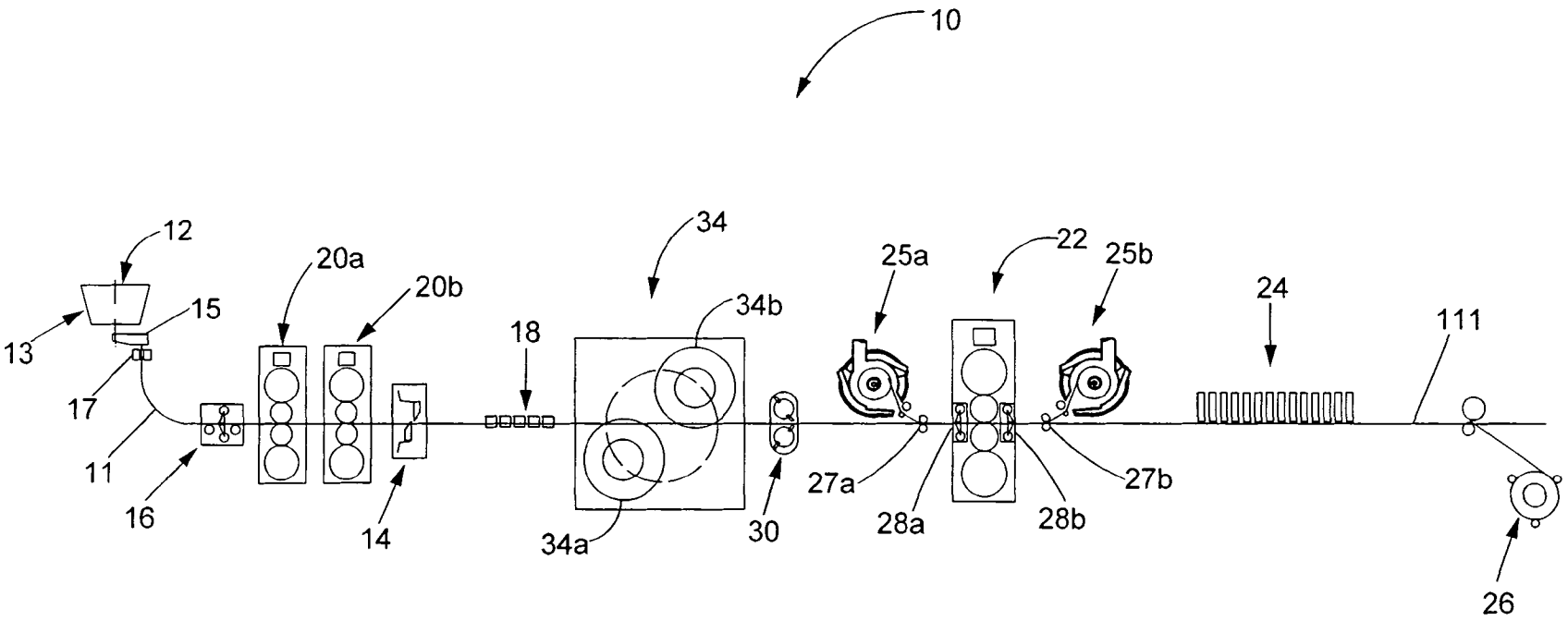
FIG. 2 schematically shows a second form of embodiment of the rolling line according to the present invention.

FIGS. 1 and 2 respectively show two forms of embodiment of a rolling line 10 according to the present invention for the production of flat rolled products for example strip 111.

The rolling line 10 comprises a machine 12 for continuous casting, which produces, in this case, a thin slab 11. The machine 12 conventionally provides a ladle 13, a tundish 15 and a crystallizer 17.

In some forms of embodiment, in the curved path shown in the drawings at exit from the crystallizer 17, the thin slab 11 may be subjected to a dynamic soft reduction, in order to obtain a better metallurgic structure. According to the invention, the cast thickness, after soft-reduction, is comprised between 25 mm and 50 mm.

In some forms of embodiment, the thin slab which is cast has a width of 800-1600 mm.

The rolling line 10 of the present invention is configured overall to produce coils with a thickness from about 1.4-1.6 mm to about 8-10 mm and roll weight of 25 tons.

Since the rolling line 10 is of the low productivity type, the rolling process according to the present invention provides a casting speed of the slab 11 comprised between 3.5 and 6 m/min.

According to the present invention, at least a roughing stand 20, 20*a*, 20*b* is provided downstream of casting. Typically, the at least one roughing stand 20, 20*a*, 20*b* is of the four-high type.

In particular, according to a first form of embodiment of the present invention, shown in FIG. 1, immediately downstream of the casting machine 12 a single roughing stand 20 is provided.

In accordance with a second form of embodiment, shown in FIG. 2, two roughing stands 20*a*, 20*b* are provided, located in series.

According to the present invention, the working diameter of the rolls of the roughing stand 20, or of each of the roughing stands 20*a*, 20*b*, is comprised between 550 mm and 650 mm, preferably between 575 mm and 625 mm, for example about 600 mm. The length of the rolls is about 1500-1800 mm, for example about 1750 when the diameter is 600 mm.

Moreover, in some forms of embodiment the separation force of the roughing stand 20, or of each of the two roughing stands 20*a*, 20*b*, is about 3000 tons (30000 kN).

Furthermore, in some forms of embodiment the nominal power of the motor of the roughing stand 20, or of each of the two roughing stands 20*a*, 20*b* is 1500 kW.

The single roughing stand 20, or the pair of two roughing stands 20*a*, 20*b*, has the function of reducing the thickness of the thin slab 11 immediately exiting the casting machine 12. According to the present invention each stand allows to obtain reductions of less than about 60%, for example comprised between about 20% and about 60%, advantageously between about 35% and about 55%, of the initial thickness.

In the first form of embodiment in FIG. 1, the roughing stand 20 reduces the thickness of the thin slab 11 up to about 10 mm and 30 mm, preferably between 10 mm and 20 mm.

In the second form of embodiment in FIG. 2, the two roughing stands 20*a*, 20*b* reduce the thickness of the thin slab 11 up to about 6 mm and 20 mm, preferably between 6 mm and 15 mm.

In both forms of embodiment, the roughing stand 20, or the pair of roughing stands 20, 20*b*, is disposed immediately downstream of the casting machine 12 with which it is in direct contact without a break in continuity.

The main advantage of this disposition of the roughing stand 20, or the pair of roughing stands 20, 20*b*, is that the reduction in thickness is performed when the slab 11 is still with a very hot core, which requires a smaller stand and therefore less power installed with subsequent saving of energy.

Immediately downstream of the single roughing stand 20 or the pair of roughing stands 20, 20*b*, a first shearing unit 14 is present by means of which the shearing to size of the bar 11 is performed.

The shearing unit 14 is of the known type and in some forms of embodiment, can comprises a pendulum shear, while in other forms of embodiment it can comprise a rotary shear or "crank shear".

During the production cycle, the first shearing unit 14 shears the bar 11 into segments or pieces of a desired length, correlated to the desired weight of the coil or roll of final strip.

In particular, the length of the segments of bar is such as to obtain a coil of a desired weight, for example 25 tons, so that the rolling process is carried out in the so-called coil-to-coil mode.

Upstream of the roughing stand 20 or the pair of roughing stands 20, 20*b*, a de-scaler 16 may be provided. In some forms of embodiment, the de-scaler 16 is preferably of the type having rotary nozzles and performs a careful removal of the scale from the surface of the cast product, using the minimum delivery of water possible, with a modest drop in temperature of the cast product.

According to the present invention, downstream of the roughing stand 20 or the pair of roughing stands 20, 20*b*, and downstream of the first shearing unit 14, along the rolling line 10 a rapid heating unit is disposed, in this case an inductor furnace 18 to perform a step of rapid heating and configured to at least recover the losses of temperature coming from the pass in the at least one roughing stand 20, advantageously with the function of homogenizing and heating the cast product.

The rolling line 10 provides, downstream of the inductor furnace 18, a winding/unwinding device 34 with at least two mandrels 34*a*, 34*b*, to carry out a winding/unwinding step subsequent to the rapid heating step. The at least two mandrels 34*a*, 34*b* are able to selectively and alternatively perform the function of winding the bar coming from the at least one roughing stand 20 and to unwind it and feed it to a subsequent rolling train with a single reversing roughing stand 22 of the Steckel type which will be described more fully hereafter in the description. For example the winding/unwinding device 34 can be made as in the international application PCT/EP2010/070857 in the name of the Applicant, entirely incorporated here for reference.

In some forms of embodiment, the winding/unwinding device 34 is the heated type, to function as a furnace to at least maintain the temperature, so that during the winding/unwinding steps the bar remains at a suitable temperature for subsequent rolling in the rolling train, also reducing costs and bulk.

If the rolling mill is stopped, the winding/unwinding device 34 allows to accumulate at most two segments of bar inside it without stopping the casting machine 12, hence functioning as a store, and then introduces them again into the rolling line 10 when the rolling train 22 starts up again. In this way it is possible to operate, for example, in some functioning modes of the rolling line 10, in the event of a stoppage of the rolling train 22 in an emergency (for example blockage), or programmed stoppage (for example roll change). Advantageously, the time for winding the bar onto one or more mandrels 34*a*, 34*b* of the winding/unwinding device 34 is consistent with the time of the roll change in the stands of the rolling train.

Immediately downstream of the winding/unwinding device 34 there is an emergency shear, or crop shear 30, of a known type.

The rolling train according to the present invention is the reversing Steckel type, and according to the present invention consists of a single Steckel reversing stand 22 which cooperates with winding/unwinding reels 25*a*, 25*b*, in some forms of embodiment heated reels, also known as furnace reels. The winding/unwinding reels 25*a* and 25*b* cooperate with respective drawing units 27*a*, 27*b*.

In the solution shown, immediately upstream of the only reversing stand 22 of the rolling train there are respective de-scaling devices, indicated by 28*a* and 28*b* respectively, which perform the function of removing the scale before and/or after each rolling pass, preventing the scale from being impressed on the surface of the strip by the action of the rolling rolls.

The working diameter of the rolls of the single Steckel stand 22 is comprised between about 500 mm and 600 mm, with a length of about 2050 mm.

The working diameter of the rolls of each winding/unwinding reel 25*a*, 25*b* is about 1350 mm, with a length of 2050 mm.

The rolling method according to the present invention provides at most five double passes through the reversing stand 22, which determine the desired reductions in thickness.

For example, in the configuration in FIG. 1 having a single roughing stand 20, to produce, starting from a thin slab of 35 mm in thickness, a strip of low carbon steel having a width of about 1,300 mm, with a final thickness from 8-10 mm down to 4 mm, three rolling passes (two inversions) are sufficient, while for final thicknesses under 4 mm and down to 1.4 mm, five rolling passes (four inversions) are sufficient in the reversing stand 22 of the rolling train.

In particular, in this first form of embodiment the reduction in thickness in the single roughing stand 20 is 60% and a bar of 14 mm in thickness is obtained which in the rolling train is reduced to the final thickness, for example of 2 mm, in the following way:

- a first rolling pass through the reversing stand 22 (first reduction in thickness of the first rolling pass is about 40%) and winding onto the winding/unwinding reel 25*b;*
- a first inversion (second reduction in thickness of the second rolling pass is about 38%), with unwinding of the strip by the winding/unwinding reel 25*b* and winding onto the winding/unwinding reel 25*a;*
- a second inversion (third reduction in thickness of the third rolling pass is about 33%), with unwinding of the strip by the winding/unwinding reel 25*a* and winding onto the winding/unwinding reel 25*b;*
- a third inversion (fourth reduction in thickness of the fourth rolling pass is about 28%), with unwinding of the strip by the winding/unwinding reel 25*b* and winding onto the winding/unwinding reel 25*a;*
- a fourth inversion (fifth reduction in thickness of the fifth rolling pass is about 22%), with unwinding of the strip by the winding/unwinding reel 25*a*.

Instead, in the configuration in FIG. 2 having two roughing stands 20*a*, 20*b* to produce a strip of low carbon steel having a width of about 1,300 mm and a final thickness from 8-10 mm down to 2 mm, starting from a thin slab of 35 mm in thickness, three rolling passes (two inversions) in the rolling train are sufficient, while for final thicknesses of less than 2 mm down to 1.4 mm only five rolling passes (four inversions) are sufficient.

In particular, in this second from of embodiment the reduction in the first roughing stand is 60%, while in the second roughing stand it is 50% and a 7 mm thick bar is obtained which in the rolling train is reduced to the final thickness, 2 mm for example, in the following way:

- a first rolling pass through the reversing stand 22 (first reduction in thickness of the first rolling pass is about 41%) and winding onto the winding/unwinding reel 25*b;*
- a first inversion (second reduction in thickness of the second rolling pass is about 34%), with unwinding of the strip by the winding/unwinding reel 25*b* and winding onto the winding/unwinding reel 25*a;*
- a second inversion (third and final reduction in thickness of the third and final rolling pass is about 26%), with unwinding of the strip by the winding/unwinding reel 25*a;*

In one form of embodiment of the present invention, with two roughing stands and for thicknesses of the final strip of more than 5-6 mm, rolling in the single reversing Steckel stand 22 occurs advantageously with a single pass and therefore without inversions and without using the winding reels, therefore the exposure time of the product to the air and hence the formation of scale are both drastically reduced.

Finally, the rolling line 10 includes, after the reversing rolling stand 22 of the rolling train, a run-out table for the strip 111, at a speed of about 1.5-12 m/s, and a cooling unit 24. For example, the cooling unit 24 is of the laminar cooling type with showers.

Downstream of the cooling unit 24 the rolling line 10 comprises a winding unit 26, for example formed by a winding reel (down-coiler), of the strip 11 to produce the coils of strip.

The invention claimed is:

1. A rolling method for the production of flat products with low productivity comprising:

a) continuously casting a slab having a thickness between 25 mm and 50 mm at a speed between 3.5 m/min and 6 m/min, b) roughing the slab in a single roughing stand to reduce the slab's thickness to between 10 mm and 30 mm, c) rapidly heating the slab downstream of the casting and roughing step, d) winding and unwinding the slab in a winding/unwinding device having at least two mandrels after the step of rapidly heating, e) rolling the slab in a rolling unit having a single reversing stand, wherein the rolling step further comprises no more than three rolling passes or two inversions to produce a final slab having a thickness between 4 mm and 10 mm.

2. The rolling method of claim 1 further comprising cooling the slab.

3. The rolling method of claim 1 further comprising winding the slab.

4. The rolling method of claim 1 wherein the roughing step further comprises roughing the slab in the single roughing stand to reduce the slab's thickness to between 6 mm and 20 mm.

5. The rolling method of claim 1 wherein the rolling step further comprises two rolling passes or two inversions to produce the final slab having a thickness between 1.4 mm and 4 mm.

6. A rolling line for the production of flat products with low productivity comprising:

- a continuous casting machine configured to continuously cast a slab at a speed between 3.5 m/min and 6 m/min,
- a single roughing stand connected to an exit of the continuous casting machine and upstream of a heating unit,
- the heating unit having an induction furnace to recover the temperature lost passage through the roughing stand,
- a winding/unwinding device having at least two mandrels and configured to selectively and alternatively wind the slab arriving from the continuous casting machine and unwind the slab to feed a reversing stand of a rolling unit, wherein the winding/unwinding device is downstream of the heating unit, the rolling unit comprising a single reversing stand configured to perform a rolling operation, wherein the rolling operation comprises no more than three rolling passes or two inversions to produce a final slab having a thickness between 4 mm and 10 mm.

7. The rolling line of claim 6 wherein each of the single roughing stand is configured to allow a reduction in thickness of between 20% and 60%.

8. The rolling line of claim 6 wherein the single roughing stand is configured to perform a reduction in thickness of the slab between 6 mm and 40 mm.

9. The rolling line of claim 6 wherein the final slab has a thickness between 4 mm and 8 mm.

* * * * *